United States Patent [19]

Wilson

[11] Patent Number: 5,054,130

[45] Date of Patent: Oct. 8, 1991

[54] TOILET DEODORIZING DEVICE

[76] Inventor: Thomas R. Wilson, 2714 Beach Rd., Port Huron, Mich. 48060

[21] Appl. No.: 526,459

[22] Filed: May 21, 1990

[51] Int. Cl.[5] ..... E03D 9/052

[52] U.S. Cl. ..... 4/213

[58] Field of Search ..... 4/213, 217, 348, 211

[56] References Cited

U.S. PATENT DOCUMENTS

| | | | |
|---|---|---|---|
| 470,740 | 3/1892 | Bluhm | 4/217 X |
| 3,087,168 | 4/1963 | Huso | 4/213 |
| 3,824,637 | 7/1974 | Hunnicutt, Jr. | 4/213 |
| 3,857,119 | 12/1974 | Hunnicutt, Jr. | 4/213 |
| 3,927,429 | 12/1975 | Pearson | 4/213 |
| 3,953,901 | 5/1976 | Poister et al. | 4/213 |
| 4,044,408 | 8/1977 | Pearson | 4/213 |
| 4,117,559 | 10/1978 | Boyle | 4/213 X |
| 4,153,956 | 5/1979 | Fischer, Sr. et al. | 4/213 |
| 4,166,298 | 9/1979 | Pearson | 4/213 |
| 4,168,553 | 9/1979 | Studer | 4/213 X |
| 4,232,406 | 11/1980 | Beeghly et al. | 4/213 |
| 4,251,888 | 2/1981 | Turner | 4/213 |
| 4,344,194 | 8/1982 | Pearson | 4/213 |
| 4,583,250 | 4/1986 | Valarao | 4/213 |
| 4,617,687 | 10/1986 | Wadsworth | 4/213 |
| 4,748,698 | 6/1988 | Kao | 4/213 X |

FOREIGN PATENT DOCUMENTS

| | | | |
|---|---|---|---|
| 2548243 | 1/1985 | France | 4/217 |

*Primary Examiner*—Henry J. Recla

*Assistant Examiner*—Robert M. Fetsuga

*Attorney, Agent, or Firm*—Peter D. Keefe

[57] ABSTRACT

A toilet bowl deodorizer device which is connectable to an existing toilet, and which effectively and inexpensively provides for deodorization without affecting operation of the toilet. The first preferred embodiment of the present invention is composed of a deodorizer unit containing a motor, an optimized turbine with associated internal ducting, and a replaceable filter, which may include a perfume; a tank access duct having a universal fitting for removably connecting to the deodorizing unit; a passive relief valve member; and a tank top seal system upon which the lid may rest independently thereof. The second preferred embodiment of the present invention is composed of a deodorizer unit containing a motor, an optimized turbine with associated internal ducting, and a replaceable filter, which may include a perfume; and a ductwork located adjacent the back of the seat having a universal fitting for removably connecting to the deodorizing unit. In either embodiment, a transformer is provided remotely with respect to the toilet in order to convert line voltage to a safe, no-shockable voltage (under 28 volts) which is then delivered to the deodorizing unit. Further, a seat switch may be optionally connected in series with an electrical switch mounted to the deodorizing unit in order to provide for passive operation whenever a user sits upon the seat.

17 Claims, 3 Drawing Sheets

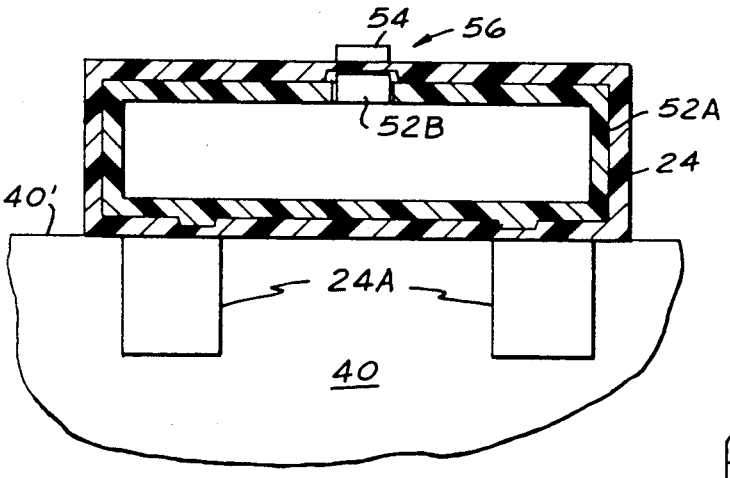
FIG.5
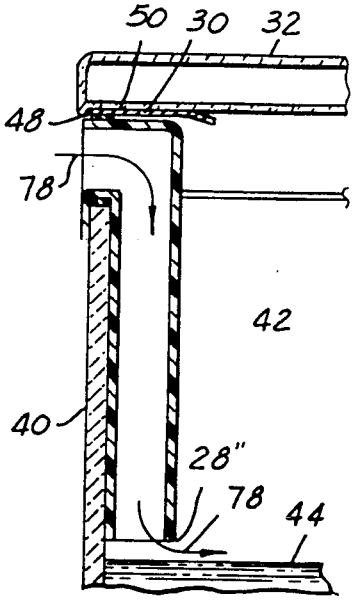
FIG.6
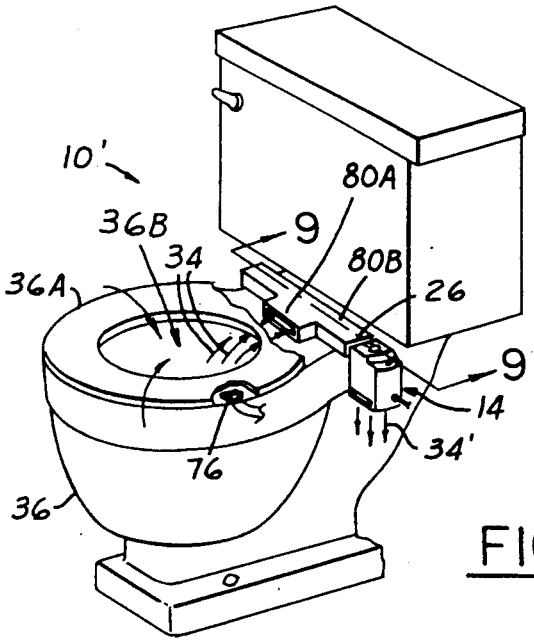
FIG.7
FIG.8
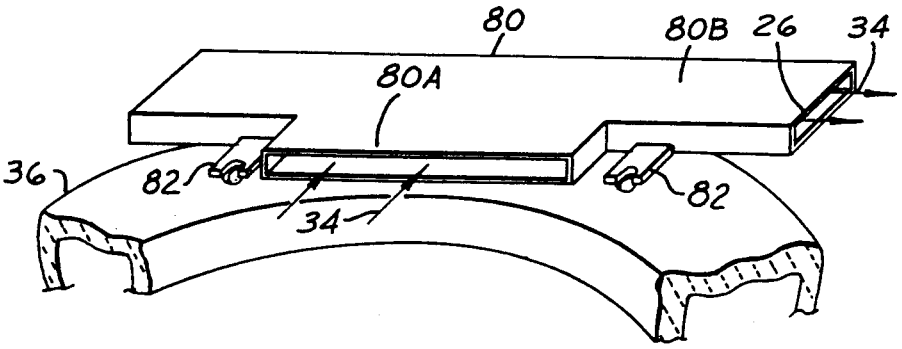

TOILET DEODORIZING DEVICE

BACKGROUND OF THE INVENTION

1. Field of the Invention

The present invention relates to devices which interconnect with a toilet in order to deodorize the air in and about the toilet bowl, and more particularly to a deodorizing device which is structured to easily attach to an existing toilet and thereupon perform in an effective manner without affecting the performance of the toilet.

2. Description of the Prior Art

Toilets are generally constructed of two basic types. The first, and most common type, is used domestically and is characterized by a bowl, a seat hingably connected with the bowl, a flush tank filled with flush water, a flush control system, and an over-flow pipe located in the tank which is connected with the bowl. The second is used commercially and is characterized by a bowl, a seat hingably connected to the bowl, and a flush mechanism connected directly to a water main.

In either type of toilet, there is a frequent problem associated with ventilation of odors attendant to the use of the toilet. In some instances, the lavatory itself is equipped with a ceiling vent which draws odors out of the lavatory. However, this solution for controlling odor is frequently inadequate because very large volumes of room air must be exhausted in order to dissipate odors that are actually concentrated in and about the toilet bowl.

In the prior art there are a number of proposals to devise a device which can remove or treat the odors in and about the toilet bowl, itself, rather than the lavatory environment in general. A first type of deodorizer device is connected to the toilet adjacent the seat and draws air directly from the toilet bowl. A second type of deodorizer device is connected with the tank and draws air from the toilet bowl via the over-flow pipe.

Examples of the first type of toilet bowl deodorizer device are as follows. U.S. Pat. No. 3,824,637 to Hunnicutt, Jr., dated July 23, 1974, discloses a toilet bowl odor remover which is composed of a ductwork located at the back of the seat which connects via a flexible hose either to an exterior vent or to an A.C. powered deodorizer; the deodorizer utilizes activated charcoal. U.S. Pat. No. 3,857,119 to Hunnicutt, Jr., dated Dec. 31, 1974, discloses a variation of U.S. Pat. No. 3,824,637, in which the deodorizer is structured to hang directly from the ductwork and includes a replaceable filter unit. Finally, U.S. Pat. No. 4,168,553 to Studer, dated Sept. 25, 1979, discloses a toilet bowl odor remover utilizing a ductwork located adjacent the rear of the seat with a flexible hose connection to a vented exhaust fan.

Examples of the second type of toilet bowl deodorizer device are as follows. U.S. Pat. No. 3,927,429 to Pearson, dated Dec. 23, 1975, discloses a toilet bowl deodorizer composed of a deodorizer unit mounted to the side of the tank, a duct connected to the deodorizer unit which enters into the tank between the tank top and the lid, a gasket seal between the tank top and the lid, and a pressure sensitive switch to shut-off the deodorizer unit when the toilet is flushed in order to facilitate flushing; the deodorizer unit is composed of a housing with internal motor, fan and activated charcoal filter. U.S. Pat. No. 4,044,408 to Pearson, dated Aug. 30, 1977, discloses a toilet bowl deodorizer of the sort indicated immediately above, but includes a battery power source for the motor and has a reed valve to prevent odors from entering the deodorizer unit when it is not in use. U.S. Pat. No. 4,153,956 to Fischer, Sr. et al, dated May 15, 1979, discloses a toilet bowl deodorizer composed of an air permeable membrane situated across and within the tank, a framework for the membrane, a deodorizer unit resting above the membrane and spacers to raise the lid above the tank top so as to let deodorized air pass out; the deodorizer unit is composed of a motor powered blower and a sanitizing heater powered by a circuit containing a transformer. U.S. Pat. No. 4,166,298 to Pearson, dated Sept. 4, 1979, discloses a toilet bowl deodorizer composed of a receptacle fashioned to hydraulically interfit with the over-flow pipe, the receptable including therein a motor, fan and deodorizing filter. Finally, U.S. Pat. No. 4,232,406 to Beeghly et al, dated Nov. 11, 1980, discloses a deodorizing system which exhausts to a vent, the system includes an air pressure relief valve that is activated by a float so that air may enter into the tank when the toilet is flushed.

While each of the prior art devices recounted above in one way or another effect to remove odors in and about the toilet bowl, there remains several problems yet unsolved.

To be effective, tank mounted deodorizing devices must have a sealed tank, yet sealing the tank via a gasket is not effective in the face of occasional bumps against the lid as are likely to happen from time to time. Further, while U.S. Pat. No. 4,166,298 discloses a device which needs no tank-to-lid sealing, it is extremely complicated and therefore too expensive to be practical for most installations, and also it does not allow for the limited space available in many toilet tank structures.

To be effective, tank mounted deodorizing devices must relieve the partial vacuum that will occur above the water-line when the toilet is flushed and the deodorizing fan is running, lest flushing occur very sluggishly. Accordingly, U.S. Pat. No. 4,166,298 solves this problem by using an expensive self-contained receptacle, U.S. Pat. Nos. 3,927,429 and 4,044,408 avoid this problem by using pressure sensitive switches to turn off the motor when flushing is initiated, U.S. Pat. No. 4,153,956 avoids this problem by using a mercury switch on the flush lever to turn off the motor, and U.S. Pat. No. 4,232,406 solves this problem by using a complicated valve and float system to regulate ventilation.

Accordingly, what is needed is a simple, inexpensive, effective and reliable deodorizing device for toilets which does not impair normal operation of the toilet.

SUMMARY OF THE INVENTION

The present invention is a toilet bowl deodorizer device which is connectable to an existing toilet, and which effectively and inexpensively provides for deodorization without affecting operation of the toilet.

The first preferred embodiment of the present invention is composed of a deodorizer unit containing a motor, an optimized turbine with associated internal ducting, and a replaceable filter, which may include a perfume; a tank access duct having a universal fitting for removably connecting to the deodorizer unit; a passive relief valve member; and a tank top seal system upon which the lid may rest independently thereof.

The second preferred embodiment of the present invention is composed of a deodorizer unit containing a motor, an optimized turbine with associated internal ducting, and a replaceable filter, which may include a perfume; and a ductwork located adjacent the back of the seat having a universal fitting for removably connecting to the deodorizer unit.

In either embodiment, a transformer is provided remotely with respect to the toilet in order to convert line voltage to a safe, no-shockable voltage (preferably under 28 volts) which is then delivered to the deodorizer unit. Further, a seat switch may be optionally connected in series with an electrical switch mounted to the deodorizer unit in order to provide for passive operation whenever a user sits upon the seat.

Accordingly, it is an object of the present invention to provide a toilet bowl deodorizing device which is safe, inexpensive, reliable and efficient, and which does not impair operation of the toilet.

It is a further object of the present invention to provide a toilet bowl deodorizing device which is able to operate even while the toilet is being flushed via a passively operating air relief valve.

It is yet another object of the present invention to provide a toilet bowl deodorizing device which will not present an electrical hazard as all electrical wiring in the vicinity of the toilet operate at less voltage than that which can deliver a shock.

It is still an additional object of the present invention to provide a toilet bowl deodorizing device in which the tank is sealed independently of the lid, so that occasional bumping of the lid by users will not affect the seal.

It is yet a further object of the present invention to provide a toilet bowl deodorizing device in which the turbine assembly is structured for optimum performance.

It is still another object of the present invention to provide a toilet bowl deodorizing device in which the user may elect to turn the device on manually, or elect to operate the device passively via a sensor located under the seat which senses the presence of a user and thereupon turns on the device automatically.

It is yet an additional object of the present invention to provide a toilet bowl deodorizing device which includes an easily replaceable filter, which may contain activated charcoal or other effective odor eradicating agents, as well as perfume.

It is still a further object of the present invention to provide a toilet bowl deodorizing device which includes an universal duct fitting so that the same deodorizer unit can be used with either a tank mount or seat mount system.

These, and additional objects, advantages, features and benefits of the present invention will become apparent from the following specification.

BRIEF DESCRIPTION OF THE DRAWINGS

FIG. 5 is a sectional side view of the connection of the deodorizer unit to the tank access duct, as seen along lines 5—5 in FIG. 2.

FIG. 6 is a sectional side view showing the passive relief valve member of FIG. 3 in operation.

FIG. 7 is a perspective view of a toilet fitted with a toilet bowl deodorizing device according to the second preferred embodiment of the present invention.

FIG. 8 is a part sectional perspective view of the ductwork according to the second preferred embodiment of the present invention.

DETAILED DESCRIPTION OF THE PREFERRED EMBODIMENTS

Figure 1:
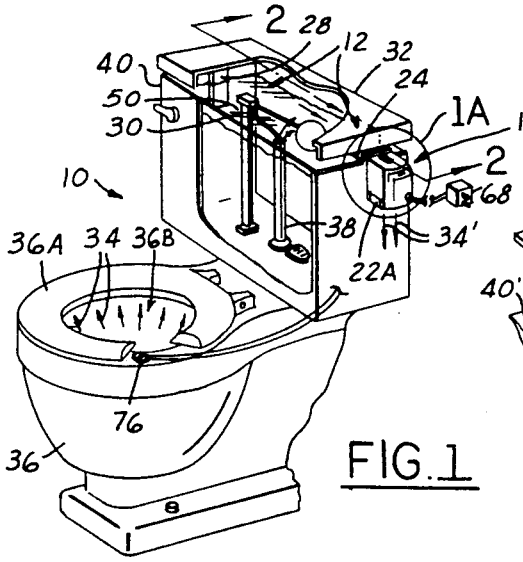
FIG. 1 is a part cut-away perspective view of a toilet fitted with a toilet bowl deodorizing device according to the first preferred embodiment of the present invention.

Referring now to the Drawing, FIG. 1 shows a conventional tank-type toilet 10 equipped with the toilet deodorizing device 12 according to the first preferred embodiment of the present invention. As can be seen by reference to both FIGS. 1 and 2, the toilet deodorizing device 12 is composed generally of a deodorizer unit 14 containing a motor 16, an optimized turbine 18 with associated internal ducting 20, and a replaceable filter 22; a tank access duct 24 having a universal fitting 26 for removably connecting to the deodorizer unit 14; a passive relief valve member 28; and a tank top seal system 30 upon which the lid 32 may rest independently thereof.

Figure 2:
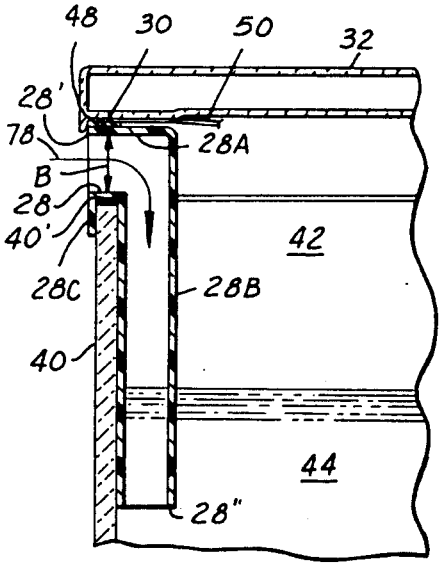
FIG. 2 is a fragmentary, part sectional side view of the first preferred embodiment of the present invention, as seen along lines 2—2 in FIG. 1.
Figure 2:
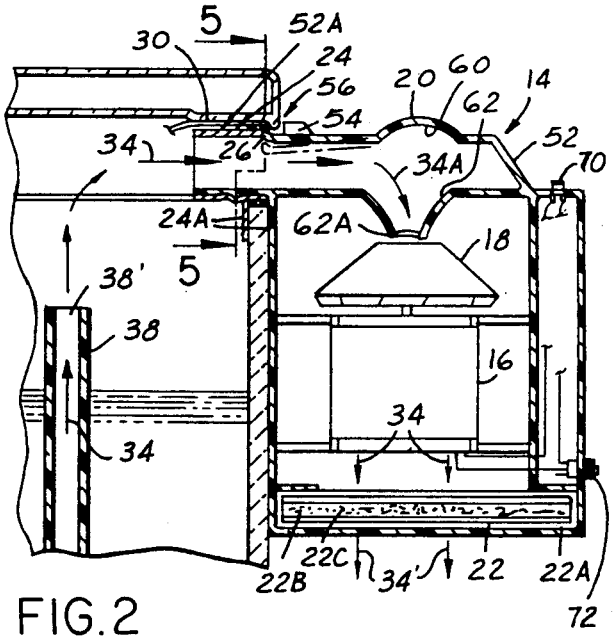

As may be discerned from an examination of FIGS. 1 and 2, the object of the toilet deodorizing device 12 is to remove odors from in and about the toilet bowl 36. In the first preferred embodiment (as represented by FIGS. 1 through 6, 10 and 11), odorous air 34 is sucked up the standard vents located in the rim of the toilet bowl 36, through the over-flow pipe 38, into the tank 40 and thereupon drawn into the deodorizer unit 14. This air movement is induced by the creation of a region 42 of reduced air pressure, relative to ambient atmospheric pressure, between the tank water 44 and the tank top seal system 30, the region 42 including the open end 38' of the over-flow pipe 38. The reduced air pressure is caused by operation of the motor 16 and turbine 18 within the deodorizer unit 14, via the ducting 20 and the tank access duct 24. The odorous air 34 then passes through the filter 22 and thereupon exits the deodorizer unit 14 in the form of conditioned air 34'.

Construction details of the first preferred embodiment of the toilet deodorizing device 12 will now be recounted with reference now being made to FIGS. 1 through 6, 10 and 11.

Commencing with a basic tank-type toilet 10 of conventional design and manufacture, the lid 32 is removed to accommodate installation of the deodorizing device 12. As may be understood from reference to FIGS. 1 and 2, at one end of the tank 40 is located the deodorizer unit 14, and at the opposite end of the tank is located the passive relief valve member 28. Each of these components includes a duct which runs into the region 42 within the tank. The construction details of these ducts may be understood by reference to FIGS. 1A and 3.

Figure 1A:
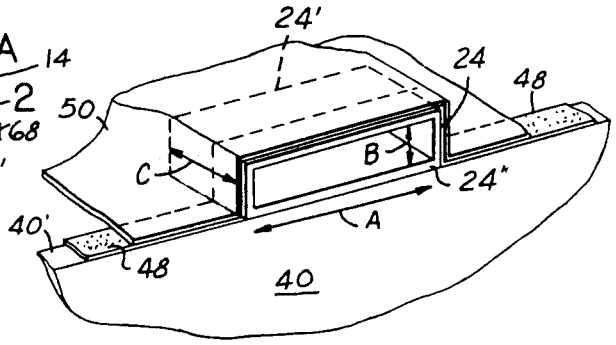
FIG. 1A is a detail perspective view of the sealing means according to the first preferred embodiment of the present invention.

Referring with particular attention to FIG. 1A, a tank access duct 24 is provided which is preferred to have a squat rectangular shape, in which the width A is much longer than the height B. As can be seen in FIG. 1A, the tank access duct 24 is box-shaped, having a length C sufficient to place the input end 24' within the region 42 of the tank. A preferred construction material is plastic. The output end 24" of the tank access duct 24 is structured to releasably accommodate installation of the deodorizer unit 14, as will be described hereinbelow. It is preferred to include a pair of tank wall flanges 24A which are mutually spaced a tank wall thickness apart (see FIG. 3 where the wall thickness D is defined) in order to secure placement of the ducting relative to the tank 40.

Figure 3:
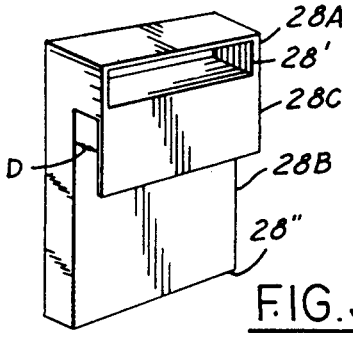
FIG. 3 is a perspective view of the passive relief valve member according to the first preferred embodiment of the present invention.
Figure 4:
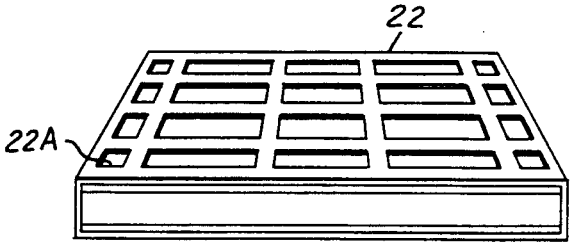
FIG. 4 a perspective view of the replaceable filter unit according to the present invention.
Figure 9:
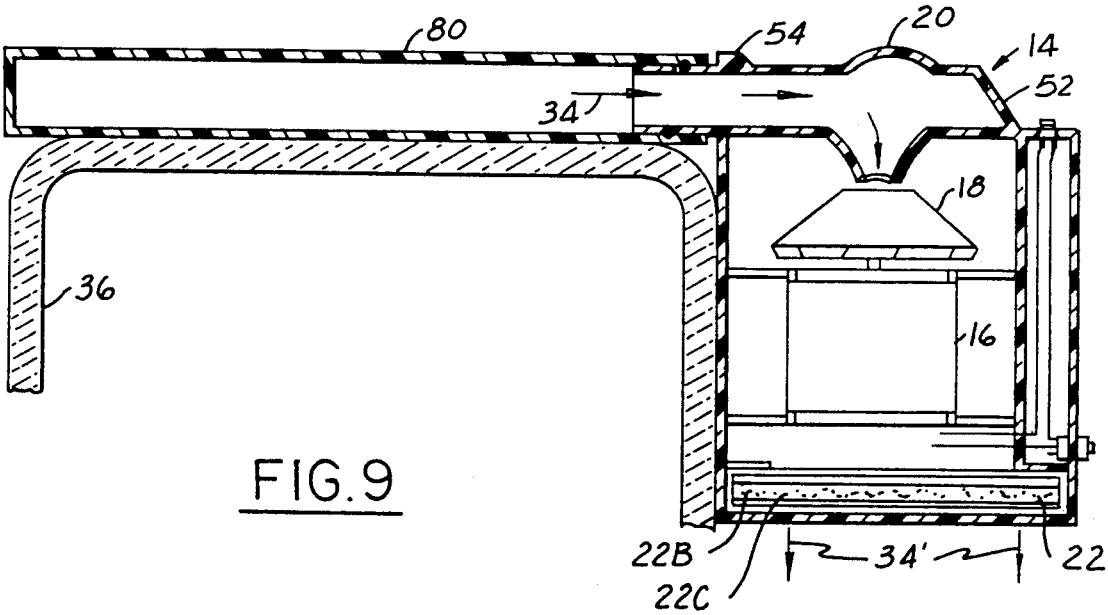
FIG. 9 is a part sectional side view of the deodorizing device according to the second preferred embodiment of the present invention, shown in operation.

Referring with particular attention to FIG. 3, it will be noted that the passive relief valve member 28 serves inherently as a duct from an input end 28' which communicates with ambient air to an output end which communicates with the interior of the tank 40 such as to penetrate a shallow distance into the water 44, as will be explained in detail hereinbelow. The construction of the passive relief valve member is in two units which are preferred to be integrally joined: a first duct 28A having height B the same as that of the tank access duct 24 and a width either the same or wider or narrower than the tank access duct, and a second duct 28B, which connects at right angles with the first duct 28A. Thus, the dimensions of the first and second ducts 28A and 28B result in rendering an inverted "L" shape to the passive relief valve member 28. A preferred construction material is plastic. It is preferred to include a tank wall flange 28C spaced a tank wall thickness D from the second duct 28B so as to positively locate the passive relief valve member onto the tank 40.

Next, after the tank access duct 24 and the passive pressure relief valve member 28 are installed on the tank 40, a tank top seal system 30 is provided which defines the region 42 within the tank. The purpose of this seal is to ensure that when the turbine sucks air from the tank 40 via the ducting 20 and tank access duct 24, only (or as close to only as is practicable) odorous air 34 will be sucked out from the over-flow pipe 38. That is, if any leaks existed in the region 42, then ambient air from the surrounding room would be sucked, thus compromising the ability of the deodorizing device 12 to remove odorous air 34 from the toilet bowl 36.

Figure 11:
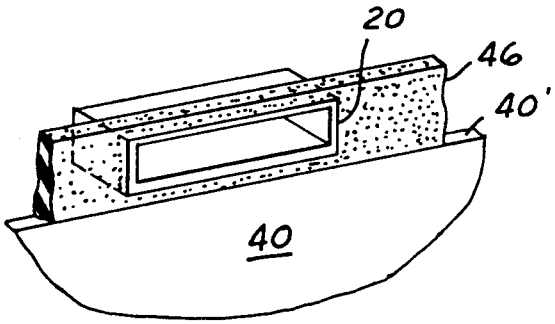
FIG. 11 is a detail perspective view of an alternative tank sealing structure utilizing a gasket.

The tank top seal system is preferred not to be in the form of a gasket between the lid 32 and the tank 40, as representatively shown in FIG. 11, because any accidental jarring of the lid will compromise the seal provided by the gasket 46 (although it is possible to construct and operate the present invention utilizing a gasket 46, as shown in FIG. 11).

It is preferred to construct the tank top seal system 30 as follows. With reference being made most facilitously to FIG. 1A, a two sided adhesive tape 48 is firstly continuously run along the top 40' of the tank 40 and over each of the tank access duct 24 and the first duct 28A of the passive relief valve member 28. Then a polymer sheet film 50 is placed over the tank top 40' and thereupon secured adhesively along the entire length of the two sided adhesive tape. While any sort of non-air permeable sheet film will suffice, it is particularly preferred to use a "shrink film" of the sort made by Frost King of Patterson, N.J., in which the film is subject to permanent shrinkage when heated, as by a hair dryer. Shrink film is preferred as it provides a clean, manicured sealing membrane after it has been secured to the two sided adhesive tape, trimmed and heated. Now the lid may be placed upon the tank top seal system 30 where it extends across each of the tank access duct 24 and the passive relief valve member 28, the seal being unaffected by the presence of the lid.

Next, the deodorizer unit 14 is installed. As may be understood by reference to FIGS. 2, 4 and 5, the deodorizer unit is composed of a housing 52 in which the internal ducting 20, the turbine 18, the motor 16 and filter 22 components are located. The housing, which is preferred to be of plastic construction, has a universal adapter at its input end 52A which is structured to fit snugly into the output end 24" of the tank access duct 24. The output end of the tank access duct is structured in the form of a universal fitting 26 which includes a boss 54. The input end 52A of the housing 52 includes a button release mechanism 56, in which a lip 52B is resiliently positioned on the housing. Thus, inserting the input end 52A of the housing 52 into the output end 24" of the tank access duct, the lip 52A will interferingly engage the boss 54 so as to retain the housing in the tank access duct. To remove the housing 52, button 58 of the button release mechanism 56 is pressed, thereby disengaging the lip from the boss and thereby permitting the housing to be removed from the tank access duct.

The construction of the deodorizer unit 12 is as follows. The internal ducting 20 of the housing 52 includes with a concave air flow facilitator 60 as well as a mutually communicating funnel shaped air flow regulator 62. Directly adjacent the lower opening 62A of the funnel shaped air flow regulator is the turbine 18. The purpose of the concave air flow facilitator 60 is to assist providing laminar air flow characteristics at the bend 34A in the air flow toward the funnel shaped air flow regulator, thereby enhancing overall air flow. The funnel shaped air flow regulator 62 directs the odorous air 34 into an optimal cross section for the turbine 18. A preferred turbine is of the type manufactured by Douglass Products of Walnut Ridge, AR. The turbine is in turn connected to an electrical motor which is operated via an electrical circuit that will be described in detail hereinbelow. Downstream of the turbine and motor is the filter 22. It is preferred for the filter to be readily and easily laterally slid into a compartment 22A, which will facilitate removal for servicing or replacement. It is preferred that the filter media 22B include activated charcoal, although the specific media for the filter is can be any suitable filter media known in the filtration arts. It is also preferred to include a scent 22B, such as perfume, in the filter 22.

Figure 10:
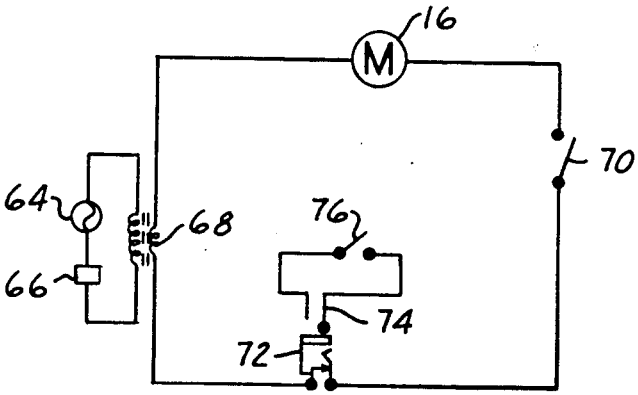
FIG. 10 is a circuit schematic for the toilet deodorizing device according to the present invention.

The electrical circuitry particulars will now be discussed with reference to FIGS. 1 and 10. It is preferred that the motor operate at a low voltage, well below that voltage for which human skin can be shocked (below about 48 volts). A preferred voltage is 12 or 28 volts. Electrical power is supplied by standard utility lines 64, usually 110 volts. Due to the high humid conditions and proximity of human users, it is preferred for this circuit to include a ground fault trip mechanism 66, which automatically cuts power if a predetermined degree of electrical short is detected. A transformer 68 located a distance from the housing 52 (on the order of 2 to 6 feet or more from the toilet) converts the utility line voltage to the aforesaid safe voltage. A power switch 70 mounted on the housing 52 selectively actuates the motor 16. It is preferred to include in the circuit a socket 72 on the housing 52 for selectively receiving a plug 74. The plug 74 is connected with an electrical circuit which includes a pressure switch 76. The pressure switch is of the type NO-1 manufactured by Tapeswitch Corporation of Farmingdale, N.Y., and is located between the seat 36A and the toilet bowl 36. The pressure switch is normally open, but is closed whenever a user sits upon the seat. Thusly, the motor may be passively actuated by a user sitting upon the seat if the plug is inserted in the socket and the power switch 70 is closed. That is, if the power switch is open, then the motor will not operate even if the user sits upon the seat. In the event the plug is inserted in the socket, then the circuit is configured such that the pressure switch 76 is in series with the power switch 70; when the plug is not inserted in the socket the circuit merely includes the power switch, the socket being shunted.

Operation will now be detailed.

With the plug 74 plugged into the socket 72, and with power switch 70 closed, a user sits upon the seat 36A, thereby closing pressure switch 76. The motor actuates, spinning the turbine and thereby causing a reduced air pressure in the region 42 above the water 44. Odorous air 34 is thusly sucked out of the toilet bowl 36 via the over-flow pipe 38 into the region 42. Odorous air then enters into the tank access duct 24 and thence into the internal ducting 20 of the housing 52. After the odorous air passes the turbine, it encounters the filter 22 whereupon it is conditioned to remove the odors, and optionally, scented. The conditioned air 34' then exits the housing into the ambient air of the lavatory. Now, if the user gets up and subsequently flushes the toilet, the motor will have stopped, and flushing will proceed normally.

With the socket absent from the plug, the motor must be manually turned on by closing the power switch. When the user gets up and flushes the toilet 10, the motor will likely still be running while flushing ensues. In order that flushing occur normally, the reduced air pressure above the water must be eliminated. This is provided by the passive relief valve member 28, whereby initial flush action will slightly reduce the level of the water to just below, or very close to, the output end 28" of the passive relief valve member 28. Accordingly, ambient air 78 may freely enter into the region 42, thereby eliminating (or at least substantially eliminating) the partial vacuum in the region 42 so that flush action will not be affected by continued operation of the motor. It should be noted that as long as there is a substantial water level above the output end 28" ambient air 78 will be effectively prevented from entry into the region 42, thus ensuring that the deodorizer unit 14 will be sucking odorous air 34 only. Thus, the location of the output end 28" must be predetermined with respect to the normal fill level of the water in the tank to ensure proper operation of the deodorizing device 12.

The second preferred embodiment of the present invention is structured to include the same circuitry and deodorizer unit 14 as recounted in detail above. However, this embodiment is different in that it is structured to be fitted upon a toilet 10' which may or may not have tank. In any event, there are no tank components of the deodorizing device 12. Instead, the odorous air 34 is drawn directly from the toilet bowl via a ductwork 80. The ductwork 80 is structured to fit adjacent the rear of the seat 36A, utilizing tabs 82 for interconnection with the standard seat fasteners located at either side of the rear of the seat. An input duct 80A is located directly beneath the seat and opens to the opening 36B of the toilet bowl 36. The input duct 80A communicates with an integrally connected transfer duct 80B. The transfer duct 80B terminates at one side of the toilet bowl in an output end in the form of the universal fitting 26. Thusly, the housing 52 and the ductwork 80 may be releasably interconnected in the manner hereinabove described for the first embodiment of the present invention.

Operation of the second embodiment of the present invention proceeds in the manner above recounted relative to the actuation of the motor via the power and pressure switches.

To those skilled in the art to which this invention appertains, the above described preferred embodiment may be subject to change or modification. For instance, a battery, particularly a rechargeable battery, could be contained in the housing for purposes of powering the motor. Such change or modification can be carried out without departing from the scope of the invention, which is intended to be limited only by the scope of the appended claims.

What is claimed is:

1. A toilet deodorizer device, said toilet deodorizer device being connectable to a conventional tank-type toilet, the toilet having a toilet bowl, a tank connected to the toilet bowl for holding flush water, the tank having a top, a seat pivotally connected to the toilet bowl, a fluid passage channel through the toilet bowl, an overflow pipe within the tank communicating with the fluid passage channel, and a lid for placement upon the tank top, said toilet deodorizer being structured to draw odorous air from in and about the toilet bowl, condition the air and then exit conditioned air to the ambient surrounding air, said toilet deodorizer device comprising:

a tank access duct structured for being located upon the tank top;

a deodorizer unit connected to said tank access duct, said deodorizer unit comprising:

a housing having at a first end and a second end;

an internal ducting adjacent said first end of said housing through which the odorous air may be directed, said internal ducting communicating with said tank access duct;

exit means located at said second end of said housing for exiting the conditioned air from the housing;

a motor located within said housing;

air filtration means located within said housing for converting the odorous air passing therethrough into the conditioned air; and air movement means connected with the motor for causing the odorous air to be drawn from said tank access duct, through said air filtration means, and thereupon to said exit means of said housing as the conditioned air;

passive relief valve means structured for being located upon the tank top for passively introducing ambient air into the tank when the toilet is flushed in order to prevent reduced air pressure in the tank from interfering with flushing, said passive relief valve means having all stationary parts, said passive relief valve means comprising:

a first duct structured for being located upon the tank top, said first duct having a first duct opening located outside the tank for communicating with the ambient air; and a second duct connected to and communicating with the first duct, said second duct having a second duct end, said second duct extending a predetermined distance for locating said second end thereof into the water of the tank so as to prevent the ambient air from entering the tank when the tank is filled with water, but permits the ambient air to enter the tank upon flushing of the toilet;

tank top seal means structured for being located upon the tank top for sealing the tank top in an at least substantially air tight manner from the ambient air; and electrical circuit means for selectively operating said motor.

2. The toilet deodorizer of claim 1, wherein said tank top seal means comprises:

a two sided adhesive tape, a first side thereof being structured for being adhesively secured upon the tank top, and for being adhesively secured upon said tank access duct and upon said passive relief valve means whereat said tank access duct and said passive relief valve means are located upon said tank top; and a non-air-permeable film structured to be located across the tank top and adhesively secured to the other side of said two sided adhesive tape everywhere therealong so as to seal the tank top in an at least substantially air tight manner from the ambient air.

3. The toilet deodorizer of claim 2, wherein the non-air-permeable film is a shrink wrap film which after being heated will shrink tightly across the top of the tank.

4. The toilet deodorizer of claim 2, wherein said electrical circuit means further comprises transformer means located remote from said housing for supplying low voltage electrical power to said motor from an external source of electrical power, said low voltage being a voltage which will not ordinarily be sufficient to render an electrical shock to a user of the toilet.

5. The toilet deodorizer of claim 4, wherein said electrical circuit means further comprises:

a power switch for selectively actuating said motor; and a normally open pressure sensitive switch selectably connectable with said electrical circuit means in series with said power switch, said pressure sensitive switch being structured to be located between the seat and the toilet bowl so that said pressure sensitive switch will passively actuate said motor when said power switch is closed and a user of the toilet sits upon the seat.

6. The toilet deodorizer of claim 5, wherein said electrical circuit means further comprises:

socket means connected with said power switch, said socket means being normally shunted; and plug means connected with said pressure sensitive switch, said pressure sensitive switch being connected in series with said power switch when said plug means is inserted into said socket means.

7. The toilet deodorizer of claim 5, wherein the electrical circuit means further comprises a ground fault detector means.

8. The toilet deodorizer of claim 7, wherein said filtration means comprises:

a filter element replaceably located within said housing; and scent means associated with said filter element.

9. The toilet deodorizer of claim 8, wherein said deodorizer unit and said tank access duct are structured for releasable connection of said deodorizer unit to said tank access duct; wherein further said ducting further comprises:

concave air flow facilitator means for aiding the movement of the odorous air through said internal ducting whereat the odorous air changes direction, and funnel shaped air flow regulator means for optimally shaping the movement of the odorous air into said air flow movement means in order to maximize efficiency of said air flow movement means; and further wherein said air flow movement means is a turbine.

10. The toilet deodorizer of claim 1, wherein said tank top seal means comprises:

a two sided adhesive tape, a first side thereof being structured for being adhesively secured upon the tank top, and for being adhesively secured upon said tank access duct and upon said passive relief valve means whereat said tank access duct and said passive relief valve means are located upon said tank top; and a non-air-permeable film structured to be located across the tank top and adhesively secured to the other side of said two sided adhesive tape everywhere therealong so as to seal the tank top in an at least substantially air tight manner from the ambient air.

11. The toilet deodorizer of claim 10, wherein the non-air-permeable film is a shrink wrap film which after being heated will shrink tightly across the top of the tank.

12. The toilet deodorizer of claim 1, wherein said electrical circuit means further comprises transformer means located remote from said housing for supplying low voltage electrical power to said motor from an external source of electrical power, said low voltage being a voltage which will not ordinarily be sufficient to render an electrical shock to a user of the toilet.

13. The toilet deodorizer of claim 12, wherein said electrical circuit means further comprises:

a power switch for selectively actuating said motor; and a normally open pressure sensitive switch selectably connectable with said electrical circuit means in series with said power switch, said pressure sensitive switch being structured to be located between the seat and the toilet bowl so that said pressure sensitive switch will passively actuate said motor when said power switch is closed and a user of the toilet sits upon the seat.

14. The toilet deodorizer of claim 13, wherein said electrical circuit means further comprises:

socket means connected with said power switch, said socket means being normally shunted; and plug means connected with said pressure sensitive switch, said pressure sensitive switch being connected in series with said power switch when said plug means is inserted into said socket means.

15. The toilet deodorizer of claim 14, wherein the electrical circuit means further comprises a ground fault detector means.

16. The toilet deodorizer of claim 1, wherein said filtration means comprises:

a filter element replaceably located within said housing; and scent means associated with said filter element.

17. The toilet deodorizer of claim 1, wherein said deodorizer unit and said tank access duct are structured for releasable connection of said deodorizer unit to said tank access duct; wherein further said ducting further comprises:

concave air flow facilitator means for aiding the movement of the odorous air through said internal ducting whereat the odorous air changes direction, and funnel shaped air flow regulator means for optimally shaping the movement of the odorous air into said air flow movement means in order to maximize efficiency of said air flow movement means; and further wherein said air flow movement means is a turbine.

* * * * *